United States Patent [19]

Kluge et al.

[11] 4,046,369

[45] Sept. 6, 1977

[54] MACHINE FOR FEEDING INSERTS TO A SEPARATING DEVICE

[76] Inventors: Willi Kluge; Reinhard Kluge, both of Kugelberg 55, 6300 Giessen, Germany

[21] Appl. No.: 683,386

[22] Filed: May 5, 1976

[51] Int. Cl.[2] ..... B65H 1/22; B65H 1/30; B65H 3/04; B65H 3/06

[52] U.S. Cl. ..... 271/3.1; 198/459; 271/151; 271/237; 271/240; 271/244; 271/270; 271/275

[58] Field of Search ..... 271/3.1, 151, 35, 216, 271/270, 202, 182, 229, 37, 237, 244, 122, 124, 221, 222, 238, 240, 275; 198/459, 454, 455, 462

[56] References Cited

U.S. PATENT DOCUMENTS

| | | | |
|---|---|---|---|
| 486,089 | 11/1892 | Crowell | 271/124 X |
| 749,986 | 1/1904 | Dick | 271/122 |
| 2,133,263 | 10/1938 | Wolff | 271/3.1 X |
| 3,643,939 | 2/1972 | Nussbaum et al. | 271/3.1 X |
| 3,756,591 | 9/1973 | Müller | 271/3.1 X |
| 3,874,652 | 4/1975 | Bilbrey | 271/35 |
| 3,880,419 | 4/1975 | Swanson | 271/3.1 |

*Primary Examiner*—Bruce H. Stoner, Jr.
*Attorney, Agent, or Firm*—Blanchard, Flynn, Thiel, Boutell & Tanis

[57] ABSTRACT

A machine for feeding inserts, for example, newspaper advertisements, to a device which separates or orients the inserts into a shinglelike arrangement and delivers them to a device which inserts them into the main portion of the newspaper. An oscillating or vibrating plate is utilized which moves into and out of the flow path of the inserts to strike the inserts from a direction which is perpendicular to the path of movement thereof to gradually orient the inserts as they move along a conveyor belt toward the separating device. A diaphragm plate effects the proper separation of the inserts prior to their delivery to the device which effects an insertion of the insert into the main portion of the newspaper.

19 Claims, 7 Drawing Figures

MACHINE FOR FEEDING INSERTS TO A SEPARATING DEVICE

FIELD OF THE INVENTION

The invention relates to a machine for feeding of inserts to a separating device, comprising at least one conveyor belt which carries the overlapping inserts and moves same to the separating device.

BACKGROUND OF THE INVENTION

In order to be able to insert newspaper advertisements or other folded newspaper inserts into newspapers, such inserts must be fed to an inserting device on a conveyor belt at a certain speed and at a certain distance from one another, namely synchronously with the rhythm at which the newspapers which are to be filled are fed to the inserting device itself. For this purpose, the inserts which are stacked as usual must be removed from their stack and must be placed onto a conveyor belt which feeds same to the mentioned separating device. The inserts are positioned on the conveyor belt extensively overlapping one another in many layers, namely it is possible to feed with a relatively slow moving conveyor belt large amounts of inserts to the separating device. The separating itself is accomplished by very suddenly accelerating the respectively underlying insert through friction rollers at the change point of the continuous conveyor belt. The insert is engaged by fast-running conveyor rollers and it can be freed from the inserts which overlap it and can be fed to a belt which runs quickly and synchronously with the inserting device. In order that only the insert which is the lowest and in front is accelerated, a gap is provided which can be adjusted in height, the height of which gap corresponds, to the thickness of the respective insert or the fold of the insert, which fold lies in front in the direction of movement. The inserts are thereby fed from the conveyor belt to a carrier which lies in the belt plane, for example to a plate, which forms the lower gap limit.

It is known to arrange above the mentioned carrier of the insert which is to be accelerated a diaphragm plate which is inclined with respect to the carrier, the lower edge of which diaphragm plate limits the mentioned gap. This diaphragm plate is suppose to hold, on the one hand, a small storage of inserts and on the other hand successive inserts having shifted folds. Only if the shifted folds are secured will the separating device operate reliably. If the fold of a later insert extends into the gap prior to the undermost insert, the latter then blocks the gap for the earlier one and the operation is interrupted. The mentioned storage is, on the other hand, necessary in order to exclude an interruption of the insert flow and thus the exiting of newspapers without inserts from the inserting device.

Separating devices can process a large number of pieces, for example 25,000 inserts per hour. This means that the insert conveyor belt must feed to the mentioned device also 25,000 inserts per hour and must itself be loaded with the same number. This can only be carried out by a few operators if the inserts can be removed in bundles from the ready stacks and can be thrown immediately onto the belt without alignment and with a more or less arbitrary orientation of the folds and by stopping the bundle lying on the conveyor belt with the flat hand. However, in the case of this type of loading of the conveyor belt, a perfect shifting of the folds of the inserts which engage the diaphragm plate of the separating device is not achievable.

The purpose of the invention is to convert the irregular insert flow on the conveyor belt, that is irregular with respect to number and alignment, to a form such that the desired necessary fold position and fold shifting of the folds on the diaphragm plate of the separating device is achieved with certainty.

The inventive device which has been produced to attain this purpose is characterized by at least one oscillatably supported diaphragm plate which can be periodically oscillated by a drive and which moves into the flow of the inserts, the oscillating direction of which diaphragm plate is determined such that it impacts or strikes the inserts which accumulate at the diaphragm plate opposite to their direction of movement to effect an alignment of the inserts.

Means can be provided behind the diaphragm plate which define a gap of adjustable height and, for example, permit only three inserts to pass therethrough. If the overlapping is thereby $\frac{2}{3}$ of the size of the inserts measured in conveying direction, then the fourth insert which follows three inserts must enter into the gap, when same is not as yet entirely free, even though only the second and third insert is in the gap. This is due to the fact that sharp bends cannot form at the overlapping points. In order to achieve a secure introduction of the fold of each insert into the gap, the diaphragm plate can be suspended and can be driven such that it carries out during each complete oscillation both a movement against the conveying direction of the inserts and also a movement at an acute angle relative thereto. Through the movement of the control plate in its plane or approximately in this plane, a compressing of each fold of each insert is achieved when same is supposed to enter into the gap.

A lateral alignment of the inserts can take place in front of the diaphragm plate. One can thus prevent angular or orientation errors of the inserts with respect to the transport direction and improves the achieving of the necessary shift in the folds.

BRIEF DESCRIPTION OF THE DRAWINGS

Two exemplary embodiments of the invention will be described hereinbelow in connection with the drawings, in which.

DETAILED DESCRIPTION

Figure 1:
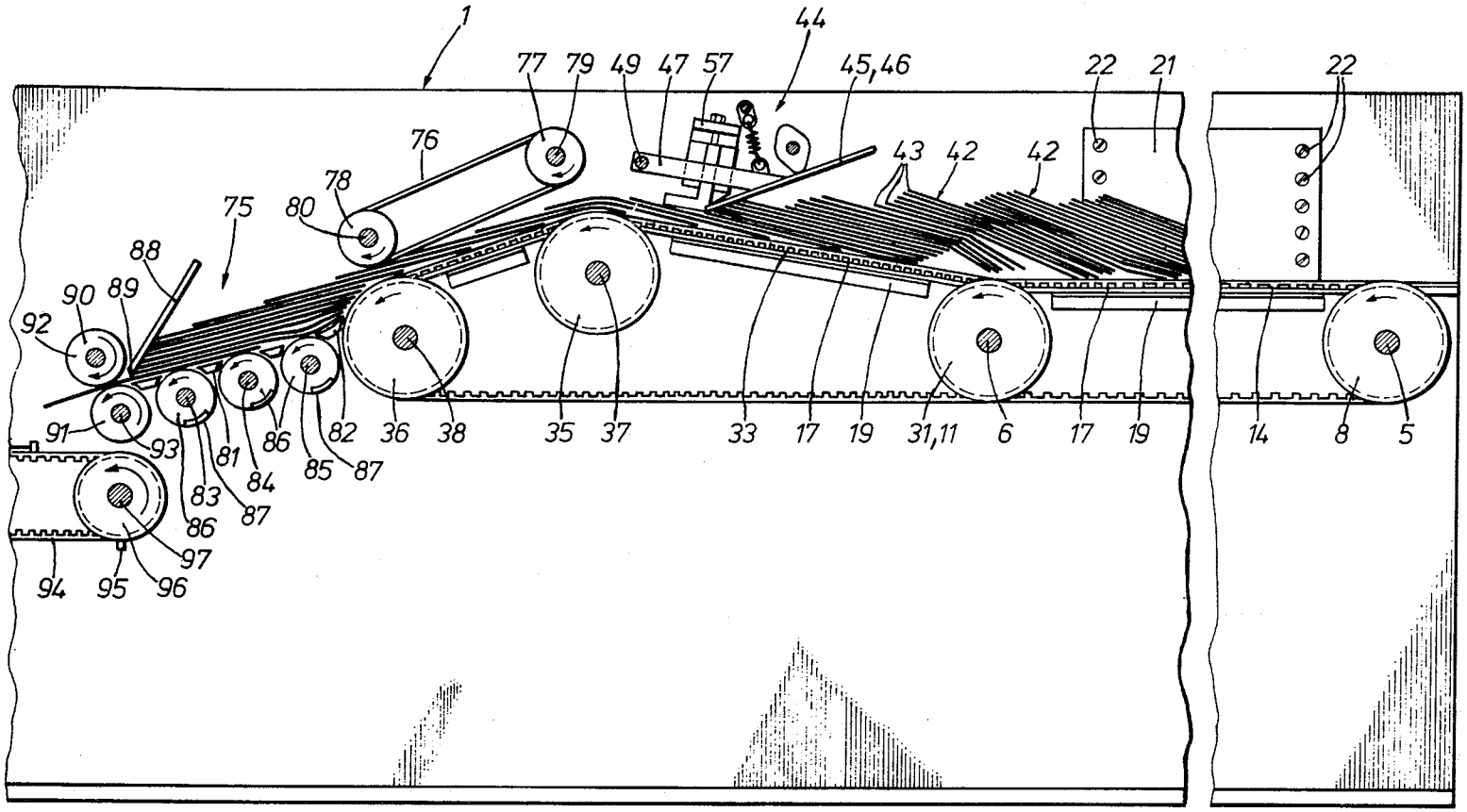
FIG. 1 is a longitudinal cross-sectional view of a separating device in connection with a feeding device according to the invention.

The entire device which will be described hereinbelow, namely the separating device and the feeding device, is supported in a common frame, which consists substantially of two side walls 1, which are held together by not illustrated spacer rods. Each side wall consists of three parts 2, 3 and 4. The parts 2 and 4 of both side walls extend parallel to one another. The parts 4 are spaced a greater distance from one another than the parts 2 and are connected to both side walls 2 and 4 by the angled parts 3.

Figure 5:
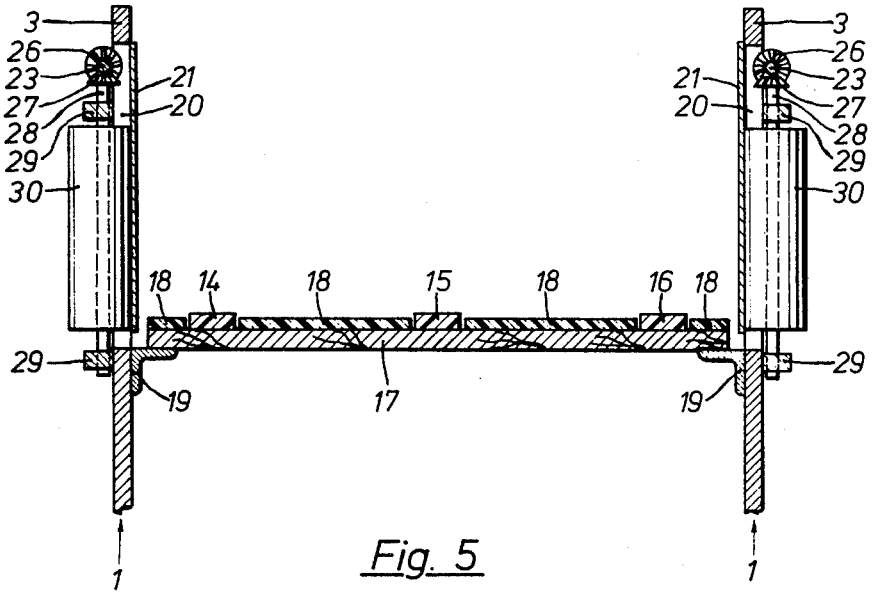
FIG. 5 is a cross-sectional view taken along the line V—V of FIG. 2.

Two shafts 5 and 6 are supported at both ends in the parts 4 and 2, respectively. The shaft 6 carries a pinion 7, which is driven by a not illustrated motor. Three gears 8, 9 and 10 and 11, 12 and 13 are mounted on each shaft 5 and 6, respectively. These gears are, as shown in FIG. 1, coupled by internally toothed belts 14, 15 and 16. The upper strand of the belts are (FIG. 5) supported by plates 17. Plastic plates 18 are positioned between the plates 17 and do not quite have the height of the belts 14, 15 and 16. The plates 17 lie on metal angle parts 19 which are secured on the inside surface of the wall parts 3.

The wall parts 3 have recesses 20 located above the plates 17 which are covered toward the inside by thin steel plates 21. The end edges of these steel plates are secured through screws 22 on the wall parts 2 and 4. A shaft 23 is supported in bearings 24 on the outside of each wall part 3. The shaft 23 carries a gear 25 at one end which is driven by a not illustrated motor. Three bevel gears 26 are positioned on each shaft 23. Each of these bevel gears is in engagement with a bevel gear 27 on a shaft part 28. The shaft parts 28 are supported in rails 29 and carry eccentric disks 30, which are used to set the steel plates 21 into oscillation, namely into oscillations which are directed perpendicularly with respect to the belts 14 to 16.

Figure 3:
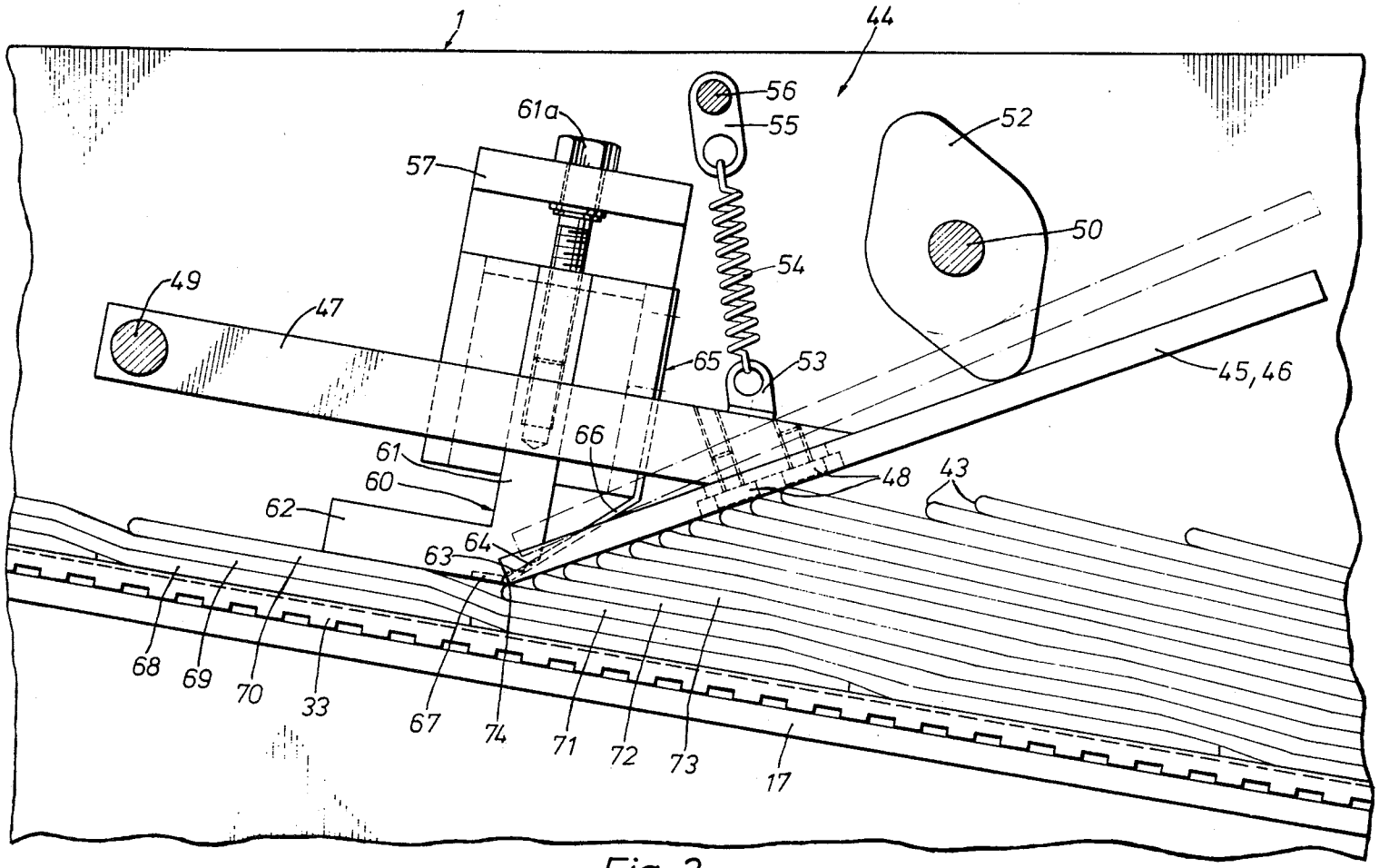
FIG. 3 is a fragment of FIG. 1 in an enlarged scale.

The shaft 6 carries also two gears 31 and 32 and have toothed belts 33 and 34 engaged therewith. Each of these belts 33 and 34 engages further gears 35 and 36, the supporting shafts of which are identified by reference numerals 37 and 38 (FIG. 1) and are supported at both ends in the wall parts 2. Thus each shaft 37 and 38 carries two gears. The belts 33 and 34 are supported in the same manner as the belts 14, 15 and 16, namely by plates 17 (FIG. 3). The spaces between the belts are occupied by plastic plates 39.

Figure 2:
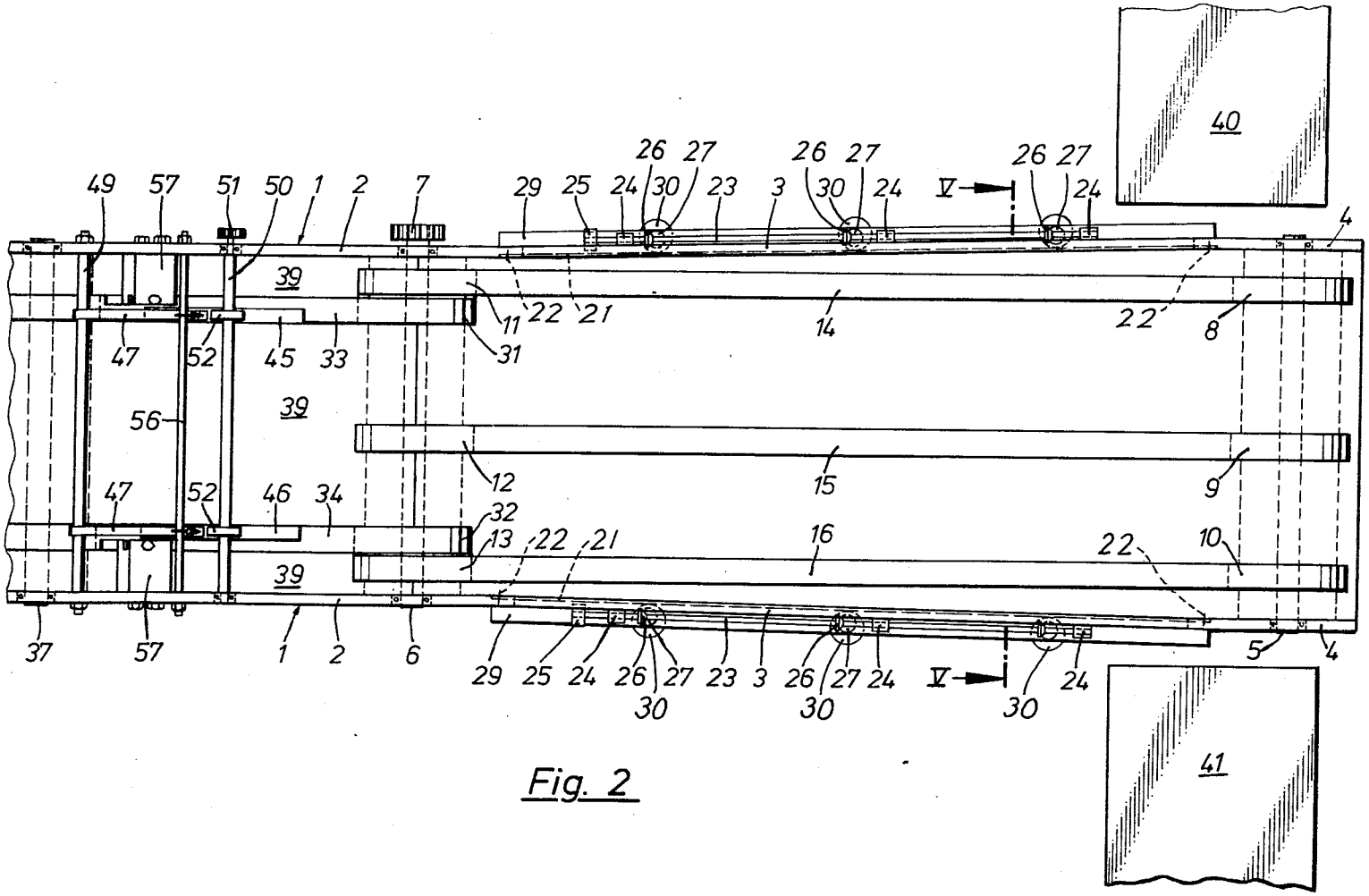
FIG. 2 is a top view of the feeding device according to FIG. 1.

FIG. 2 identifies two stacks of inserts with reference numerals 40 and 41. From these stacks, the inserts are placed in bundles, one at a time, onto the moving belts 14, 15 and 16. After they are placed on the belts, they are moved leftwardly into the shaft which is illustrated in FIG. 1 by holding back the front edge of each bundle, namely the individual bundles 42 lie on the belts overlapping one another and with a more or less sorted shift in the folds in each bundle. The folds of the inserts identified with reference numeral 43 lie each in front in the direction of movement.

In order to achieve the desired and necessary regular shifting of the fold 43 of the inserts, first of all an alignment of the bundles perpendicularly to the transport direction must take place. This alignment is effected by the oscillating steel plates 21, which apply impacts, which are directed perpendicularly to the direction of movement of the bundles, on the inserts in the individual bundles. The bundles which already lie on the belts 33 and 34 in FIG. 1 are already aligned, however, only perpendicularly with respect to the conveying direction, namely the alignment in conveying direction is missing and, as a result, the necessary alignment of the shifted folds is lacking. In order to create this alignment, a device 44 is used which is arranged above the belts 33 and 34. The device 44 consists of two narrow diaphragm plates 45,46. Each diaphragm plate is secured by screws 48 to a lever arm 47. The fastening is such that the mentioned diaphragm plates are movable in direction of their plane relative to the arms 47, for example, by using slotted holes or a dovetailed guideway. The arms 47 are pivotal about a shaft 49, which is secured in the side walls 1 of the device. A shaft 50 is rotatably supported in the side walls 1 and is driven by a gear 51 (FIG. 2) by a not illustrated motor. A cam 52 is positioned on the shaft 50 for each diaphragm plate 45,46 and effects, during each rotation of the shaft 50, two vibratory movements of the control cams 45,46 about the axis 49. A spring 54 engages at one end each arm 47 through an eyelet 53 secured thereto and at the other end is secured to a shaft 56 through a second eyelet 55. The shaft 56 is positioned fixedly in the side walls 1.

Figure 4:
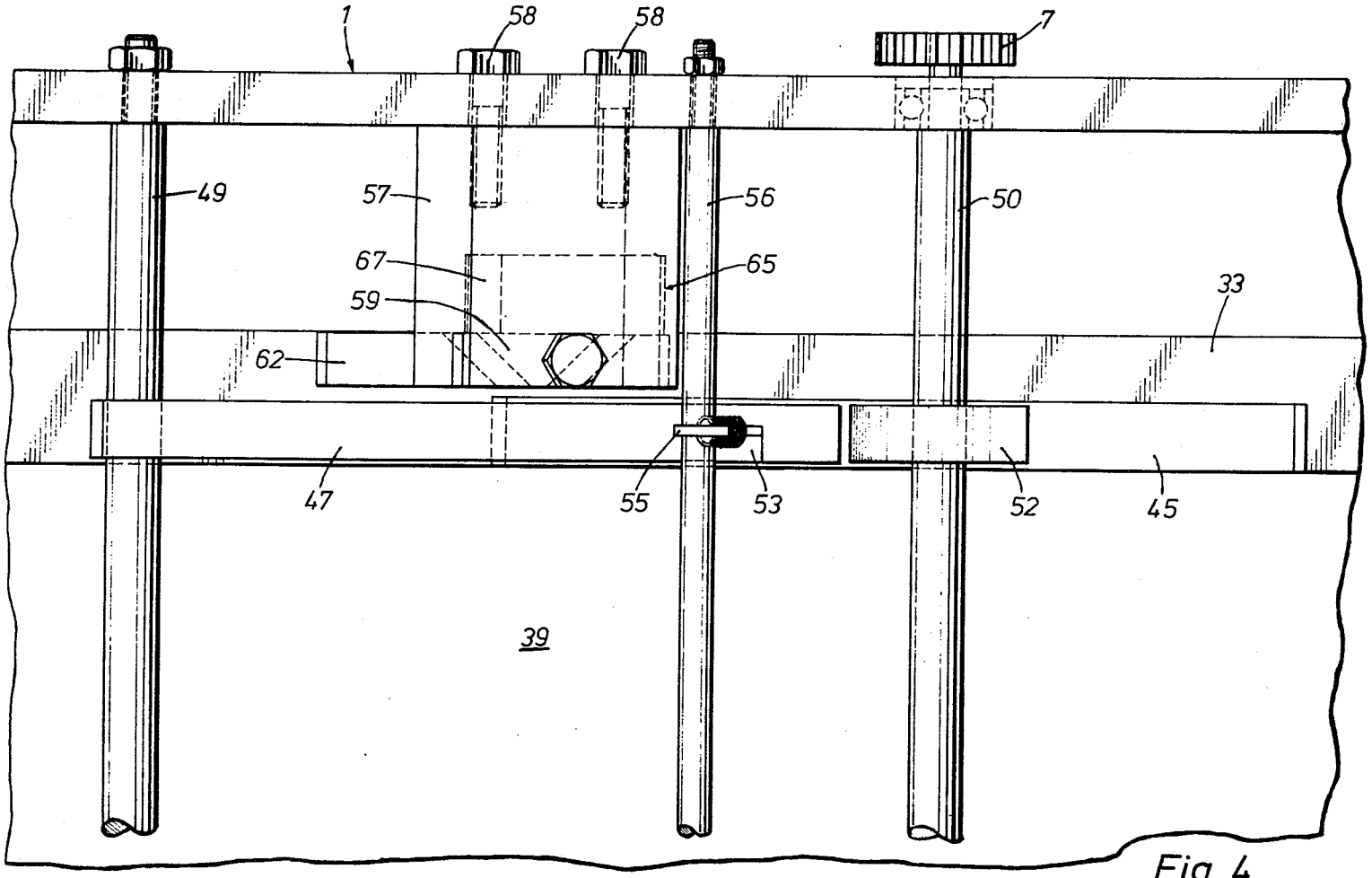
FIG. 4 is a top view of the fragment of the feeding device illustrated in FIG. 3.

A block 57 (FIGS. 3 and 4) is secured with screws 58 to each side wall 1. An angled part 60 is guided in the block 57 in a dovetail 59. The angled part 60 can be vertically adjusted and secured in position by the use of a screw 61*a*. The vertical leg 61 of the angled part 60 is positioned perpendicularly to the part of the belt 33 passing therebelow, while the second leg 62 extends parallel to the mentioned belt and defines a gap between the lower surface of the leg 62 and the belt 33. The gap is dimensioned in the exemplary embodiment so that three inserts can simultaneously pass through the gap. The front corner of the angled part 60 is step-shaped in cross section. The two steps are identified with reference numerals 63 and 64 in FIG. 3.

A thin leaf spring 65 is secured to each block 57 at the front right side thereof. The leaf spring is bent rearwardly from the lower front edge of the block 57. The bent leg part is identified with reference numeral 66 and the end 67 is again bent rearwardly so that it lies parallel to the lower edge of the leg 62.

OPERATION

The device operates as follows:

The shaft 50 of the cam 52 is driven at such a rotational speed that the diaphragm plates 45,46 carry out a full oscillation for each insert. If, for example, 25,000 inserts per hour are to be separated, this means that seven inserts per second must pass through the device and, as a result, the diaphragm plates 45,46 must carry out seven oscillations per second.

The gap between the leg 62 and the belt 33 or 34 is adjusted, in the exemplary embodiment, so that three inserts identified with reference numerals 68, 69 and 70 can pass between the leg 62 and the belt 33, whereby these inserts have a large shift between the folds, namely, and referring to FIG. 3, the inserts overlap approximately 2/3 of the preceding insert.

The insert identified with reference numeral 71 in FIG. 3 is shown in a position in which it has just been pressed from the lower recess 63 of the angle part 60 by the lower edge 74 of the diaphragm plates 45,46 so far that it can enter into the gap. FIG. 3 illustrates the lowermost position of the edge 74. The folds of all following inserts have been moved into the position illustrated in FIG. 3 during the downward movement of the diaphragm plates 45,46 and their preceding movements, namely they have been aligned perpendicularly with respect to the working direction. Since a larger number of inserts always accumulates above the insert 71 — this storage is necessary to avoid interruptions in the insert flow — a larger number of pushes are exerted onto the inserts, before they reach the position of the insert 71.

During the upward movement of the diaphragm plates 45,46 by the spring 54, the diaphragm plates reach the dash-dotted position of FIG. 3. The lower edge of both plates has thereby such a position that the inserts 72,73 which follow the insert 71 can enter into the mentioned recesses 63,64. The already described operation is repeated thereafter, whereby with a suitable shifting in the folds the insert 72 passes into the gap.

The inserts leave, as is shown in FIG. 1, the device 44 in form of a regular overlap and are fed behind the gears 36 to a separating device 75. In order to assure the achieved order of the inserts on the belt parts between the gears 35 and 36, continuous belts 76 are used which are looped around two gears 77 and 78. These gears are positioned on shafts 79,80, which are supported in the side walls 1. The belt 76 runs in the same direction as the belts 33,34 on their way to the gears 36.

The separating device 75 as such is known, so that only its important parts are illustrated. Part of it is a plastic plate 81, the upwardly bent end 82 of which follows the belts 33,34. Three shafts 83, 84 and 85 are positioned under the plate 81, which shafts are supported in the side walls 1 and are driven by a not illustrated motor at a circumferential speed which is substantially greater than the speed of the belts 33,34. Each of the shafts carries three side-by-side positioned rollers 86 which extend through openings in the plastic plate 81 and directly contact the inserts. Each roll 86 has a rubber segment 87 on its periphery, which rubber segment is used to frictionally carry the inserts along.

Two diaphragm plates 88 which are titled with respect to the plate 81 are used to accumulate the inserts, namely to provide a storage. The inserts accumulate in front of these diaphragm plates whereby, however, each insert maintains the required fold shifting. The angle of inclination of the diaphragm plates 88 can be adjusted so that the size of the gap between the lower end 89 of the diaphragm plate and the plate 81 can be adjusted to correspond to the thickness of the fold of the inserts which are to be separated.

Accelerating rollers of the separating device are identified with reference numerals 90 and 91. Their associated shafts 92,93 are supported in the side walls 1. They are driven by gears, which are not illustrated, in such a manner that their circumferential speed is approximately twice as fast as the speed of one of the rollers 86. A conveyor belt 94 with carriers or lugs 95 thereon is internally toothed and engages a rotatable gear 96 mounted on a shaft 97. The shaft 97 is also synchronously driven through a gear with the not illustrated inserting device. The carries or lugs 95 form together with the belt 94 individual compartments for the inserts so that the inserts can now be fed synchronously to the inserting device.

ALTERNATE CONSTRUCTION

Figure 6:
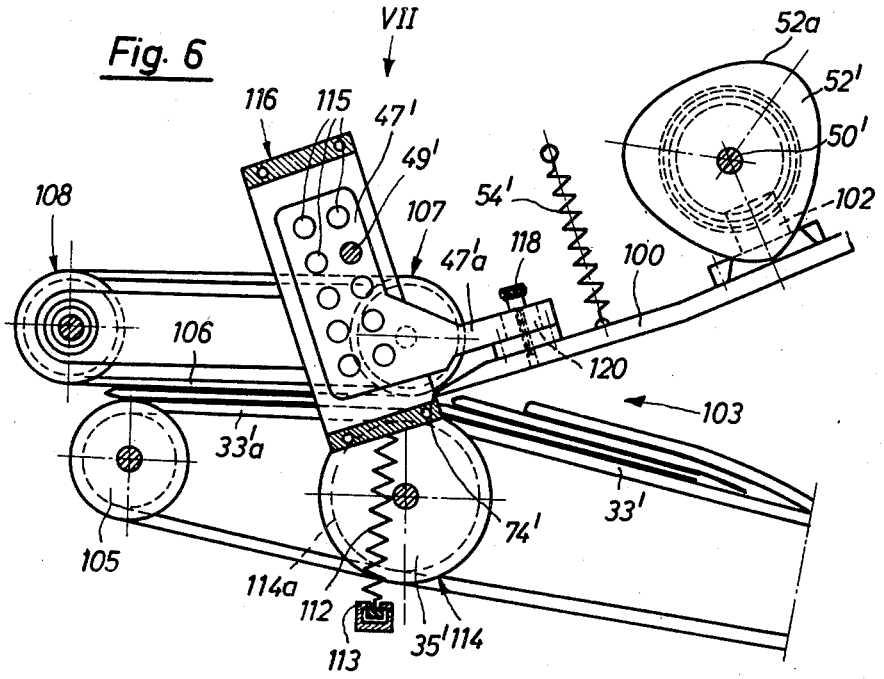
FIG. 6 is a partial vertical sectional view of a further embodiment according to line VI—VI of FIG. 7.
Figure 7:
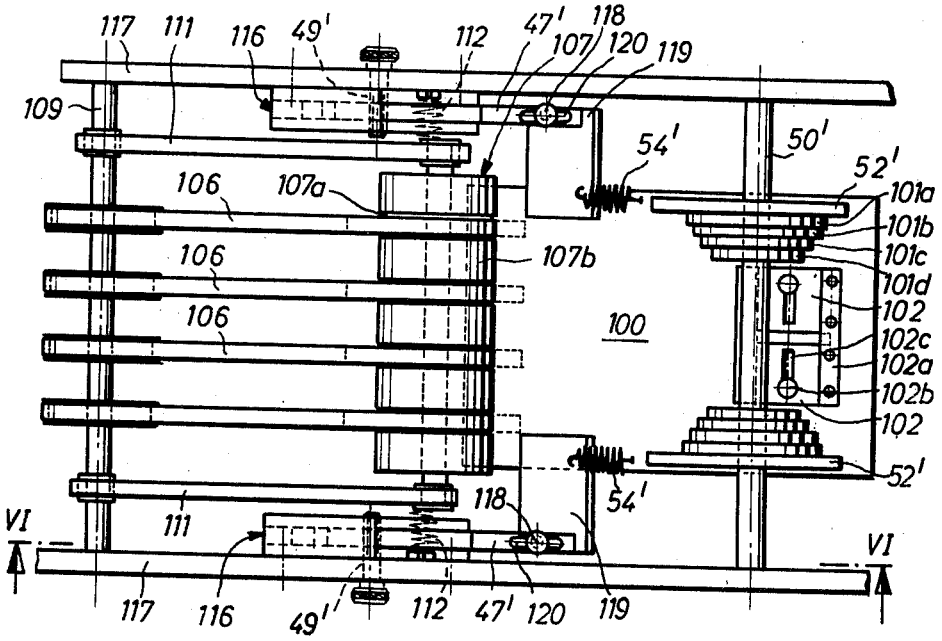
FIG. 7 is a partial top view of said embodiment corresponding with the arrow VII in FIG. 6.

FIGS. 6 and 7 illustrate a modification, in which the diaphragm plate is arranged and constructed slightly differently and in which behind the diaphragm plate there is provided an upper belt and press rollers.

The diaphragm plate 100 is constructed as a continuous plate, that is, it is not, as in the above-described embodiment, divided into two individual narrow plates 45,46. The plate 100 is secured on arms 47', which are pivotal about the axes of shafts 49'. The diaphragm plate is pulled against two cams 52' by two springs 54', which cams are rotatably mounted on a drivable shaft 50'. Furthermore, groups of stop plates **101*a*** to 101*d* are positioned on the shaft 50'. The diameters of the stop plates **101*a* to 101*d* are different, the stop plate 101*a* being the largest diameter and the stop plate 101*d*** being the smallest diameter.

A stop 102 cooperates with each group of stop plates and is movable in a guideway **102*a* which is fixedly mounted on the diaphragm plate 100 and can be fixedly positioned in various positions. The further the stops 102 are moved from their illustrated innermost position toward the outside, the smaller is the amplitude of deflection which the diaphragm plate 100 can carry out. In the illustrated position (see FIG. 7), the steps 102 do not act, because they lie inside the area of the stop plates 101*a* to 101*d*. When the stops are moved forwardly (outwardly), they contact, depending on their position, one of the plates 101*a*** to 101*d*. Starting with this contact a further oscillatory movement of the control plate is not possible. The cam surface **52'*a* moves then first away from its abutting face on the diaphragm plate and contacts same again not before its next elevation has arrived over the diaphragm plate. The stops 102 can be secured to the diaphragm plate 100 by means of screws 102*b* which extend through slots 102*c* in the stops 102**.

The front edge 74' of the diaphragm plate 100 is not arranged in the rising part or midway along the inclined part of the conveyor belt with respect to the conveying direction of the inserts symbolized by the arrow 103, as this is the case in the embodiment according to FIGS. 1 to 5, but is, instead, approximately at the highest point of this conveyor belt.

An upper belt 106 is arranged opposite the section **33'*a* of the conveyor belt 33', the lower strand of which is opposite the section 33'*a* and extends parallel to same. The upper belt 106 is guided over a press roller 107 and some drive rollers 108. At this point it is remarked that the upper belt 106 consists of several parallel individual belts, as shown in the design according to FIG. 7. The same is also true for the conveyor belt 33'**.

The press roller 107 is supported on arms 111 which are pivotal about the shaft 109 and on which the drive rollers 108 are located. Springs 112 engage the arms 111 and are anchored on a part 113 which is fixedly connected to the machine frame or side wall to continuously urge the arms 11 downwardly.

The press roller 107 has grooves **107*a* for engagement of the upper belts 106. Between the grooves 107*a* and at the roller ends there are provided sections 107*b*, the diameter of which is the same or slightly less than the outside diameter of the belts 106 in the area of the engagement with the press roller 107 so that the belts 106 do not project or only slightly project over the outer cylindrical diameter of the section 107*b***.

A further press roller 114 exists below the press roller 107, which press roller 114 serves simultaneously as a guide roller for the belt 33' consisting of four narrow individual belts. Also the press roller 114 has grooves **114*a* corresponding with the grooves 107*a* of the press roller 107 for engagement of the diverse narrow belts. The press roller 114 is rigidly supported. Drive rollers 105 are arranged in front of the press roller 114. The belt section 33'*a* is provided between the press roller 114 and the guide rollers, which belt section extends parallel to the strand of the upper belt 106**.

The arms 47', with which the diaphragm plate 100 is secured, have each an arrangement of a total of ten holes 115 (FIG. 6) which are arranged in two parallel rows. The arms 47' are received in pockets 116 which are secured on side plates 117 of the machine frame. The support shafts 49' for the diaphragm plate 100 are placed from outside through the frame plates 117 and grip through the pockets 116. The same hole arrangements as exist in the arms 47' exist in the side plates 117 and the pockets 116. Depending on the desired characteristic of movement of the diaphragm plate 100, the shafts 49' are inserted. The shafts 49' have threads at least at their front ends and are screwed into threaded holes in the pockets 116. The arrangement of many holes permits in a simple manner an optimum adjustment of the device.

The arms 47' are connected to the diaphragm plate 100 through screws 118. For this purpose, laterally extending shoulders 119 exist on the diaphragm plate 100 and engage parts 47'*a* of the arms 47'. Slotted holes 120 exist in these arm parts 47'*a,* through which holes extend screws 118. The screws 118 are screwed into the lateral shoulders 119 of the diaphragm plate 100. The described fastening permits a shifting of the diaphragm plate 100 relative to the arms 47' and thus an exact system line-up.

The device according to FIGS. 6 and 7 operates principally in the same manner as the device according to FIGS. 1 to 5. It is due to the arrangement of an upper belt 106 also particularly suited for the conveying of thin inserts, namely inserts which are too light to result in a sufficient carrier force or momentum caused alone through their weight as compared with a freely running lower belt 33'*a* without an oppositely positioned upper belt. The arrangement of the pair of press rollers 107, 114 results in a pressing of the fold of the inserts so that it is possible to process safely inserts which are inclined to bulge out at the fold.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for feeding overlapped inserts to a separating device for separating the inserts, said machine having conveyor means which carries said overlapped inserts and moves same to said separating device, the improvement comprising wherein at least one diaphragm plate is provided, a front side of said diaphragm plate facing said inserts and said conveyor means defining an acute angle therebetween, support means for supporting said diaphragm plate for oscillatory movement comprising, during each complete oscillation, a movement in a direction opposite the direction of movement of the conveyor means and an angular movement to vary the size of said acute angle and drive means for periodically oscillating said diaphragm plate in the flow path of said inserts, said oscillating diaphragm plate striking said inserts which accumulate at said front side thereof in a direction opposite to said direction of movement of said conveyor means, said striking of said inserts effecting a shifting between and an accurate control of the space between the leading edges of said inserts.

2. The improved machine according to claim 1, wherein said diaphragm plate is pivotally supported for movement about axes extending through arms which are secured to said diaphragm plate.

3. The improved machine according to claim 2, wherein said arms each have several holes therein into which shafts can be selectively placed so that the position of the shafts, about which said diaphragm plate can be pivoted, can be adjustably selected.

4. The improved machine according to claim 1, wherein immediately downstream of said diaphragm plate there are provided limit means for limiting the height of a passage between said conveyor belt and said diaphragm plate.

5. The improved machine according to claim 4, wherein said limit means for limiting the height of said passage includes adjustment means for facilitating an adjustment of said height.

6. The improved machine according to claim 5, wherein said diaphragm plate is pivotally supported for movement about axes extending through arms which are secured to said diaphragm plate and including slotted holes arranged in said arms and screws received in said slotted holes for adjustably connecting said diaphragm plate to said arms.

7. The improved machine according to claim 4, wherein said limit means for limiting said passage height have recesses therein, which recesses are superposed at their front side and are offset in the conveying direction of the inserts and each receive one insert edge therein.

8. The improved machine according to claim 4, wherein said limit means for limiting the passage height includes a spring which effects a holding down of the edges of said inserts upon entrance into said passage.

9. The improved machine according to claim 1, wherein upstream of said diaphragm plate on both sides of said conveyor means oscillating plates are provided which converge toward said diaphragm plate to laterally limit the path of said inserts.

10. The improved machine according to claim 9, including second drive means for driving said oscillating plates periodically laterally of the direction of movement of said conveyor means.

11. The improved machine according to claim 9, wherein a part of said conveyor means extending upstream of said diaphragm plate is inclined upwardly toward said diaphragm plate.

12. The improved machine according to claim 4, including rotatably driven cams engaging said diaphragm plate to effect said oscillatory movement.

13. The improved machine according to claim 12, wherein at least one cam and several stop plates having various diameters are mounted on one cam shaft, said stop plates having a circular periphery which is concentric to the axis of rotation of said cam shaft, and wherein an adjustable stop which can be adjusted transversely to said stop plates is arranged on said diaphragm plate and engages a stop plate in order to limit the path of movement of said diaphragm plate, whereby the amount of movement depends on the adjustment of said adjustable stop.

14. The improved machine according to claim 1, wherein said diaphragm plate is constructed as a continuous plate.

15. The improved machine according to claim 1, wherein the edge of said diaphragm plate closest to said conveyor means lies opposite the highest point of a conveyor guide roller for said conveyor means and wherein said conveyor means is a belt whose path on both sides of said guide roller define a downwardly open obtuse angle.

16. The improved machine according to claim 1, wherein downstream of said diaphragm plate, there is arranged a pair of press rollers, the axes of which extend horizontally and at a right angle to the direction of movement of said conveyor means.

17. The improved machine according to claim 1, wherein downstream of the diaphragm plate, there is arranged an upper belt, which cooperates with a lower belt provided therebelow for gripping the band of overlapped inserts therebetween.

18. The improved machine according to claim 17, wherein the downstream end of said upper belt, seen in conveying direction of the inserts, lies slightly downstream of the downstream end of said lower belt.

19. The improved machine according to claim 17, wherein behind said diaphragm plate, there is arranged a pair of press rollers, the axes of which extend horizontally and at a right angle to the direction of movement of said conveyor means and wherein said upper belt and said lower belt encircle said press rollers, said press rollers having peripheral grooves for receiving belts therein.

* * * * *

UNITED STATES PATENT AND TRADEMARK OFFICE

CERTIFICATE OF CORRECTION

PATENT NO. : 4 046 369

DATED : September 6, 1977

INVENTOR(S) : Willi Kluge and Reinhard Kluge

It is certified that error appears in the above-identified patent and that said Letters Patent are hereby corrected as shown below:

Column 8, line 45; change "Claim 4" to ---Claim 1---.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*